US011781391B2

(12) United States Patent
Haugland

(10) Patent No.: US 11,781,391 B2
(45) Date of Patent: Oct. 10, 2023

(54) SYSTEM AND METHOD FOR CLEANING A PRODUCTION TUBING

(71) Applicant: Altus Intervention (Technologies) AS, Stavanger (NO)

(72) Inventor: Lasse Haugland, Bryne (NO)

(73) Assignee: Altus Invervention (Technologies) AS, Stavanger (NO)

( * ) Notice: Subject to any disclaimer, the term of this patent is extended or adjusted under 35 U.S.C. 154(b) by 326 days.

(21) Appl. No.: 16/472,569

(22) PCT Filed: Dec. 13, 2017

(86) PCT No.: PCT/NO2017/050324
§ 371 (c)(1),
(2) Date: Jun. 21, 2019

(87) PCT Pub. No.: WO2018/117854
PCT Pub. Date: Jun. 28, 2018

(65) Prior Publication Data

US 2019/0316443 A1 Oct. 17, 2019

(30) Foreign Application Priority Data

Dec. 22, 2016 (NO) ..... 20162045

(51) Int. Cl.
*E21B 27/00* (2006.01)
*E21B 37/00* (2006.01)
(Continued)

(52) U.S. Cl.
CPC ..... *E21B 27/00* (2013.01); *E21B 27/02* (2013.01); *E21B 27/04* (2013.01); *E21B 34/14* (2013.01); *E21B 37/00* (2013.01); *E21B 23/14* (2013.01)

(58) Field of Classification Search
CPC ..... E21B 37/00; E21B 27/00; E21B 27/005; E21B 27/02; E21B 27/04; E21B 31/08; E21B 23/14
See application file for complete search history.

(56) References Cited

U.S. PATENT DOCUMENTS 1,445,575 A * 2/1923 Zublin ..... E21B 27/00 175/320
2,008,523 A * 7/1935 Thomas ..... E21B 27/00 175/239
(Continued)

FOREIGN PATENT DOCUMENTS

GB 2454884 A 5/2009
NO 335492 B1 12/2014
(Continued)

*Primary Examiner* — Blake Michener
(74) *Attorney, Agent, or Firm* — GableGotwals

(57) ABSTRACT

A method of cleaning production tubing in a producing petroleum well comprising the steps: i) providing collection tool configured for both selectively collecting debris while residing downhole to obtain collected debris as well as selectively releasing collected debris while residing downhole; ii) lowering collection tool to specific location at certain depth into production tubing of the producing petroleum well where there is at least a partial choking of local production flow due to accumulated debris deposited on production tubing; iii) collecting accumulated debris with collection tool to obtain collected debris; iv) pulling collection tool to production zone of production tubing or downstream of production zone where there will be enough production flow during production to ensure lifting capacity for collected debris; and v) releasing collected debris into production zone of production tubing to obtain released debris being lifted by production flow when production is running. The invention leads to time and cost savings during cleaning of production tubing.

17 Claims, 7 Drawing Sheets

(51) Int. Cl.

| | |
|---|---|
| ***E21B 27/02*** | (2006.01) |
| ***E21B 34/14*** | (2006.01) |
| ***E21B 27/04*** | (2006.01) |
| ***E21B 23/14*** | (2006.01) |

(56) References Cited

U.S. PATENT DOCUMENTS

| | | | | |
|---|---|---|---|---|
| 3,500,933 | A * | 3/1970 | Burba, Jr. | E21B 27/00 166/311 |
| 4,190,113 | A * | 2/1980 | Harrison | E21B 37/00 166/107 |
| 4,603,739 | A | 8/1986 | Krugh | |
| 5,402,850 | A | 4/1995 | Lalande et al. | |
| 6,196,319 | B1 * | 3/2001 | Henskens | E21B 37/00 166/163 |
| 7,048,056 | B1 * | 5/2006 | Blake | E21B 37/00 166/312 |
| 2005/0217861 | A1 * | 10/2005 | Misselbrook | E21B 37/00 166/373 |
| 2007/0131426 | A1 * | 6/2007 | Telfer | E21B 29/00 166/301 |
| 2007/0181298 | A1 * | 8/2007 | Sheiretov | E21B 17/1021 166/212 |
| 2010/0258296 | A1 * | 10/2010 | Lynde | E21B 37/00 166/105.1 |
| 2010/0258298 | A1 | 10/2010 | Lynde et al. | |
| 2012/0118571 | A1 * | 5/2012 | Zhou | E21B 27/00 166/301 |
| 2014/0262299 | A1 * | 9/2014 | Tinnen | E21B 27/00 166/107 |
| 2014/0326510 | A1 * | 11/2014 | Wessel | E21B 4/04 175/61 |
| 2014/0345103 | A1 * | 11/2014 | Osaland | E21B 37/02 29/700 |
| 2015/0218901 | A1 * | 8/2015 | Juhlin | E21B 43/088 166/105.1 |
| 2015/0240583 | A1 * | 8/2015 | Mineo | E21B 27/04 166/104 |
| 2016/0341026 | A1 * | 11/2016 | Leitch | E21B 43/121 |
| 2017/0009545 | A1 * | 1/2017 | Haugland | E21B 27/04 |
| 2017/0114636 | A1 * | 4/2017 | Kruger | E21B 49/082 |
| 2017/0306714 | A1 * | 10/2017 | Haugland | E21B 33/1275 |

FOREIGN PATENT DOCUMENTS

| | | | | |
|---|---|---|---|---|
| WO | 2010053374 | A1 | 5/2010 | |
| WO | WO-2010053374 | A1 * | 5/2010 | B08B 9/0436 |
| WO | 2012085556 | A2 | 6/2012 | |

* cited by examiner

SYSTEM AND METHOD FOR CLEANING A PRODUCTION TUBING

CROSS-REFERENCE TO RELATED APPLICATIONS

This United States application is the National Phase of PCT Application No. PCT/NO2017/050324 filed 13 Dec. 2017, which claims priority to Norwegian Patent Application No. 20162045 filed 22 Dec. 2016, each of which is incorporated herein by reference.

FIELD OF THE INVENTION

The invention relates to a method of cleaning a production tubing in a producing petroleum well. The invention also relates to a collection tool for carrying out such method. The invention further relates to a downhole tool assembly comprising such collection tool.

BACKGROUND OF THE INVENTION

It is well known in the petroleum industry that debris and deposits, collectively termed debris, accumulate in the production tubing. The debris form a narrow passage choking the production flow and may block the production flow completely. In addition, the debris forms an obstacle for the passing of bottom hole tools and make well intervention work difficult. There are several sources for the debris. Particles follow the flow of hydrocarbons and water from the reservoir. Sand screens may leak particles.

The particles may be fine particles such as fine sand and silt.

Production tubing in deviating and in horizontal wells are in particular exposed for settling of debris and congestion.

Sand may be produced from one or several production zones, and some production zones may be blocked completely. Some well paths, such as S-formed well path comprising horizontal and vertical portions, are in particular sensitive to settled debris.

Production from a petroleum well is most efficient when the well path is clean and free from sand and debris.

It is known to use coiled tubing for cleaning of such constricted or blocked wells. When installed, a coiled tubing operation may wash out a considerable amount of debris in a short time. This is advantageous. However, a coiled tubing operation suffers from several disadvantages, in particular on offshore installations. A coiled tubing operation requires several heavy units and equipment, including a tower comprising a gooseneck for introduction of the coiled tubing into the well. Thus a considerable amount of units are transported by ship to an offshore installation or on trucks to land based units. A number of heavy lifts are required, and offshore, the clean out operation may pause due to bad weather. In addition, installation of the coiled tubing equipment requires redeployment of other equipment. A number of people is required for the operation as well. After completed mission, the coiled tubing is demobilized with the same logistic implications. The total cost of a coiled tubing operation is high, therefore the clean out operation is put off as long as possible, and may even be avoided.

As a precautionary measure, wells may be drained gently to avoid that sand and silt are brought into the production tubing. A loss of production volume may occur if the well is drained too gently. A trade-off is therefore necessary between a production loss and operational cost by the mobilization of coiled tubing.

Two methods are available when a production tubing is cleaned out by coiled tubing. The debris may be collected in collection chambers or wash out by injection of a liquid through the coiled tubing from the surface and down into a live well. Production from production zones adds to the fluid volume as well. The fluid is returned to the surface in the annulus between the coiled tubing and the production tubing. The returning fluid carries the loosened debris and the debris is separated from the fluid in separators at the surface. During the cleaning the fluid may be led through a so-called test separator. The test separator separates particles, washing fluid and hydrocarbons into three material streams.

Wash out by coiled tubing is efficient. Debris is whirled up and washed out. In a short time, a portion of considerable length is washed out and blocked production zones are reopened. After termination of the operation, the well is retuned to ordinary production with contribution from all the production zones in the reservoir. The particles that are washed out, are collected in a separator. The separator is easy to open and clean. By this method, personal is to a limited extent exposed to the material.

Use of a venturi junk basket for collection of debris in a receptacle is more time consuming. In many cases, this method is replaced by the use of wireline and combined wireline—tractor technology. This alternative technology utilizes a mechanical means for transporting debris into a collecting chamber. The collecting chamber may also be filled by applying a sub-pressure in the collecting chamber relative to the ambient pressure. When the collecting chamber is full, the tool is transported to the surface and the collection chamber is emptied. Thereafter the tool is prepared and again lowered in the production tubing. There are limitations to this method, and the method is time consuming.

Cleaning by means of wireline-operated tools is overall efficient if the volume of debris is limited. A roundtrip in the well collects a rather small volume of debris and the labour involved is relative extensive. However, the mobilization of a wireline operated tools is easy compared to the mobilization of a coiled tubing operation and the total work and logistic effort involved is moderate. A wireline-operated tool is inefficient in removal of substantial amounts of debris compare to a coiled tubing wash out operation It is therefore a trade-off between volume of debris and total cost. In some situations, the total cost favours a coiled tubing operation and in some situations wireline-based tools are the preferred choice. An ordinary coiled tubing operation on an offshore installation lasts for between two and four weeks from start of mobilization and to complete demobilization. An ordinary wireline operation lasts for a comparable shorter period, typically from 5 to 10 days. A round trip with a wireline operated tool lasts for 6-12 hours. Known collection equipment has a capacity of collecting between 10 and 50 litres of debris for each round trip.

Wash out is a method that cannot be performed with known wireline operated tools and procedures.

Illustrative Example for a Wireline Operation:

A production tubing of 177.8 mm (7 inch, 29 lb/ft) diameter

Production tubing capacity 19.38 litres per meter.

A 100 m long column of debris in this tubing comprises 1938 litres of debris.

Maximum capacity of a wireline operated collection tool is 50 litres.

A minimum of 39 round trips are required for complete collection of the debris.

Each round trip requires between 6 and 12 hours.

A total of between 10 and 20 days is required for this operation.

A collected volume of 50 litres is according to prior art recognized as a large volume for a round trip. The collecting capacity may be smaller due to restrictions in the well path and due to a short sluice.

In view of the above-described trade-off, there is a clear need for improving the existing systems and methods of cleaning a production tubing in a petroleum well.

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

In a first aspect the invention relates particularly to a method of cleaning a production tubing in a producing petroleum well. The method comprises steps of:

- providing a collection tool that configured for both selectively collecting debris while residing downhole to obtain collected debris as well as selectively releasing the collected debris while residing downhole;
- lowering said collection tool to a specific location at a certain depth into the production tubing of the producing petroleum well where there is at least a partial choking of a local production flow due to accumulated debris deposited on the production tubing;
- collecting said accumulated debris with the collection tool to obtain collected debris;
- pulling said collection tool to a production zone of the production tubing or downstream of said production zone where there will be enough production flow during production to ensure a lifting capacity for the collected debris, and
- releasing said collected debris into the production tubing to obtain released debris being lifted by the production flow when production is running.

The effect of the features of the method in accordance with the invention is as follows.

In the prior art in many cases a wireline tractor is used for the displacement of the collection tool in the production tubing. The wireline tractor positions the collection tool adjacent to or into the debris at the location of the (partial) choking of the production tubing. The debris may be loose debris or consolidated debris. The collection tool is then activated. When the collection tool is full, the wireline tractor with the collection tool is pulled towards the surface. However, contrary to known practice, in the current invention, the wireline tractor and the collection tool is not pulled to the surface, but only into a production zone of the petroleum well where the debris is released. Alternatively, the wireline tractor and the collection tool can be pulled to a zone above (or downstream of) said production zone. The debris could be released into the production flow or released over an area and produced out at a later moment, preferably when collection tool string is placed out of the way of the production flow. The fluid flow in (or downstream of) the production zone needs to be sufficient to lift collected particles to surface. When the wireline tractor and the collection tool are positioned for releasing into the production flow, the wireline tractor is anchored to the tube wall by means of wheel carrying arms. The collection tool is activated such that the collection tool is emptied for collected debris. Preferably, in an embodiment, a test separator at the surface is activated and the produced liquid from the well is led through the test separator. Debris released from the collection tool is separated from the produced liquid at the test separator. The test separator is run for a time sufficient to collect all debris released from the collection tool.

In an embodiment of the method, when the collection tool is empty, the wireline tractor displaces the collection tool back to the site with settled debris, and the procedure is repeated. The wireline tractor and the collection tool may be displaced when the production liquid carries the released debris to the surface. Debris is thereby loosened, transported, released and finally moved with the liquid flow. The procedure is repeated until the well is clean. It must be stressed that a wireline tractor is not essential, yet beneficial to the invention, in particular in deviated or horizontal wells.

The benefits of the method according to the invention are numerous.

- Large amounts of debris are removed in a closed system without exposure of harmful substances to personnel.
- Time consuming displacement of the wireline tractor and the collection tool from the surface to the site with debris and return to the surface, is avoided.
- Closing of Christmas tree is avoided, except for the introduction of the tool into the production tubing and the final return.
- Reduction of pressure in the sluice, is avoided.
- Security and functional check of equipment at surface for each round trip is reduced.
- Washing of equipment and preparation for next round trip is avoided.
- Wear and tear on the wire handling equipment is reduced.
- Wear and tear of the wireline on the well wall is reduced.
- Careful displacement of equipment through restrictions in the production tubing is avoided.
- Number of required staff is reduced.

In summary, the earlier described difference between a coiled tubing operation and a wireline operation is cut by the invention. However, the invention is only applicable to wells, which are producing liquid with sufficient lifting capacity.

It is important to note that the collection tool (as known from the prior art) to be used in the method of the invention must be adapted for allowing both collection and dumping (releasing) of debris within the well. Choice of technology is dependent on the type of collector.

In order to facilitate the understanding of the invention a few expressions are defined hereinafter. The word petroleum well includes both oil and gas wells, yet the invention will be most effective in oil wells.

Wherever the word "debris" is used this must be interpreted as including debris and deposits that are formed inside of a production tubing.

In an embodiment of the method in accordance with the invention the production is started before the step of releasing said collected debris. This variant covers the situations where cleaning is carried out during production. This variant is discussed in detail in the detailed description of the figures.

In an embodiment of the method in accordance with the invention the production is started after the step of releasing said collected debris. In fact this embodiment facilitates some further embodiments that are discussed hereinafter.

In an embodiment of the method in accordance with the invention the step of releasing said collected debris is carried out during controlled movement of said collection tool. This may be either an upward or a downward movement. In both ways the collected debris is effectively laid out (released) over a distance along the production tubing. Then, when production is started the released debris is lifted up (transported) by the production flow.

In an embodiment of the method in accordance with the invention the collection tool is placed below the production zone before the production is started. This embodiment is particularly advantageous in case the collection tool is relatively large with respect to the production tubing (i.e. the annular space around the tool is small). This embodiment avoids that the collection tool is lifted up by the production tubing when the upwards forces are getting too high.

An embodiment of the method in accordance with the invention further comprises the step of anchoring said collection tool during the step of releasing said collected debris into the production tubing. This has the advantage that the releasing of said collected debris can be carried out in a more controlled manner. While the collection tool is standing still, the production flow is largely confined within the annular space between the collection and the production tubing (in some embodiment it will partly flow through the collection tool).

An embodiment of the method in accordance with the invention further comprises the step of anchoring said collection tool during the step of collecting said accumulated debris. The advantage of this embodiment is that the collection of debris is enhanced, i.e. render more effective. Quite often a force needs to be exerted on the debris for loosening it from the production tubing.

In an embodiment of the method in accordance with the invention the released debris is separated from the production flow at surface of the petroleum well using a separator tool. It goes without saying that the debris should not end up in the final produced liquid. Therefore, this embodiment advantageously removes the debris at the surface.

In an embodiment of the method in accordance with the invention the steps of lowering said collection tool, collecting said accumulated debris, pulling said collection tool, and releasing said collected debris, are repeated until all accumulated debris is removed (this means until the production tubing is substantially clean) at the location of the partial choking to restore the production at or underneath the specific location.

In preferred embodiments of the collection tool used in the method of the invention is a wireline tool. The benefits of the invention are most profound in that application area.

In a second aspect, the invention relates to a collection tool for carrying out the method in accordance with the invention. The collection tool comprises a collection chamber for containing debris and is configured for both selectively collecting debris while residing downhole to obtain collected debris as well as selectively releasing the collected debris while residing downhole. It was already mentioned that it is important to note that the collection tool (as known from the prior art) to be used in the method of the invention must be adapted for allowing both collecting and dumping (releasing) of debris within the well. All the known collection tools from the prior art are made for collecting while residing downhole and for being emptied while have been taken out of the petroleum well. In accordance with the invention the collection tool must be enhanced with the feature of controlled release of the collected debris while residing downhole. The collection tool in accordance with the invention is provided with a release valve or a release port for allowing releasing of the collected debris. The release valve may be typically a mechanical valve. The valve may be fully controllable to be opened or closed in accordance with the actual need. The release port may be simply an opening or a plurality of openings.

Wherever the wording "collecting debris" is used, this is to be interpreted as including both detaching debris (scraping, honing, drilling, etc.) as well as the actual intake/collection of the debris into the tool.

An embodiment of the collection tool in accordance with the invention is provided with a release valve or a release port for allowing releasing of the collected debris. The release valve may be typically a mechanical valve. The valve may be fully controllable to be opened or closed in accordance with the actual need. The release port may be simply an opening or a plurality of openings.

An embodiment of the collection tool in accordance with the invention further comprises a slideable friction member for engaging with the production tubing, wherein a relative position of the slideable friction member relative to the collection tool controls the state of the release valve. This embodiment is very convenient in that the release valve can be controlled by moving the collection tool in opposite directions. A more elaborated discussion can be found in the detailed description of the figures.

An embodiment of the collection tool in accordance with the invention is configured for releasing the collected debris at an upstream side of the collection tool. In this embodiment the collected debris is released at the same side of the collection tool as where the debris is collected. Either the same opening as the collection opening is used or a separate opening is provided for emptying the collection chamber. This embodiment is very challenging in that the releasing of the collected debris is preferably not to be done against the direction of the production flow. This is exactly where the embodiment hereinafter provides a solution.

An embodiment of the collection tool in accordance with the invention is configured for releasing the collected debris at a downstream side of the collection tool. The advantage of this embodiment is that the releasing of the collected debris may be done in the same direction as the production flow, which basically helps this process. In addition, the production flow may even be used to facilitate the emptying of the collection chamber as the next mentioned embodiment shows.

An embodiment of the collection tool in accordance with the invention is configured for leading the production flow at least partially from the upstream side through the collection chamber of the collection tool to the downstream side for washing out the collected debris. In this embodiment the production flow is used to effectively wash the collection chamber clean from collected debris, provided that both the inlet at the upstream side and the outlet at the downstream side are open. In addition, the debris is gradually released into the production flow.

The terms "upstream" and "downstream" are defined with regards to the direction of the production flow. "Upstream" is typically the end of the tool that is furthest away from the surface seen along the path of the petroleum well, i.e. the lower part in a vertical well. "Downstream" is typically the opposite end of the tool that is closest to the surface along the path of the petroleum well, i.e. the upper part in a vertical well.

An embodiment of the collection tool in accordance with the invention further comprises a debris collection tool for collecting the debris mechanically. The debris collection tool may be a drill bit (for example a rock bit as disclosed in NO335492). The advantage is that the debris is effectively reduced (pulverized) to very small parts that are easily lifted using the production flow. In addition to the drill bit there may be a transport screw with transport blades for transporting the pulverized debris into the collection chamber.

An embodiment of the collection tool in accordance with the invention further comprises a pump for collecting the debris. A pump forms a useful alternative to transporting the debris to the collection chamber.

An embodiment of the collection tool in accordance with the invention further comprises an anchoring device for anchoring against the production tubing for fixing the position of the collection tool. Such anchoring device may be a stroker or any another similar friction/release anchoring device.

An embodiment of the collection tool in accordance with the invention is provided with a filling level indicator for indicating the filling level of the collection chamber. Such filling level indicator may be a sensor or a flow meter.

In preferred embodiments of the collection tool of the invention is a wireline tool. The benefits of the invention are most profound in that application area.

In a third aspect the invention relates to a downhole tool assembly (may also be called a tool string) comprising a wireline tractor and the collection tool in accordance with the invention. In this embodiment the tractor may function as an anchor for the collection tool.

In a fourth aspect the invention relates to a downhole tool assembly (may also be called a tool string) comprising a docking station and the collection tool in accordance with the invention.

The docking station is to be placed in the part of the production tubing having enough production flow and may be configured to assist in opening and closing the release valve.

BRIEF INTRODUCTION OF THE DRAWINGS

In the following is described examples of preferred embodiments illustrated in the accompanying drawings, wherein:

FIGS. 1*a*-1*h* illustrate different stages of an embodiment of the method of cleaning a production tubing in accordance with the invention;

DETAILED DESCRIPTION OF THE EMBODIMENTS

FIGS. 1*a*-1*h* illustrate different stages of an embodiment of the method of cleaning a production tubing in accordance with the invention. It must be noted that these figures are very schematic and only serve to illustrate the main principles of the invention. It has been already mentioned in the introduction that the method of the invention has two main variants, one where the production is ongoing while the debris is being released, and one where the production is started after the debris has been released. Each of these variants has its own advantages and disadvantages. The first variant is illustrated in FIGS. 1*a*-1*h*.

Figures 1A, 1B, 1C, 1D:
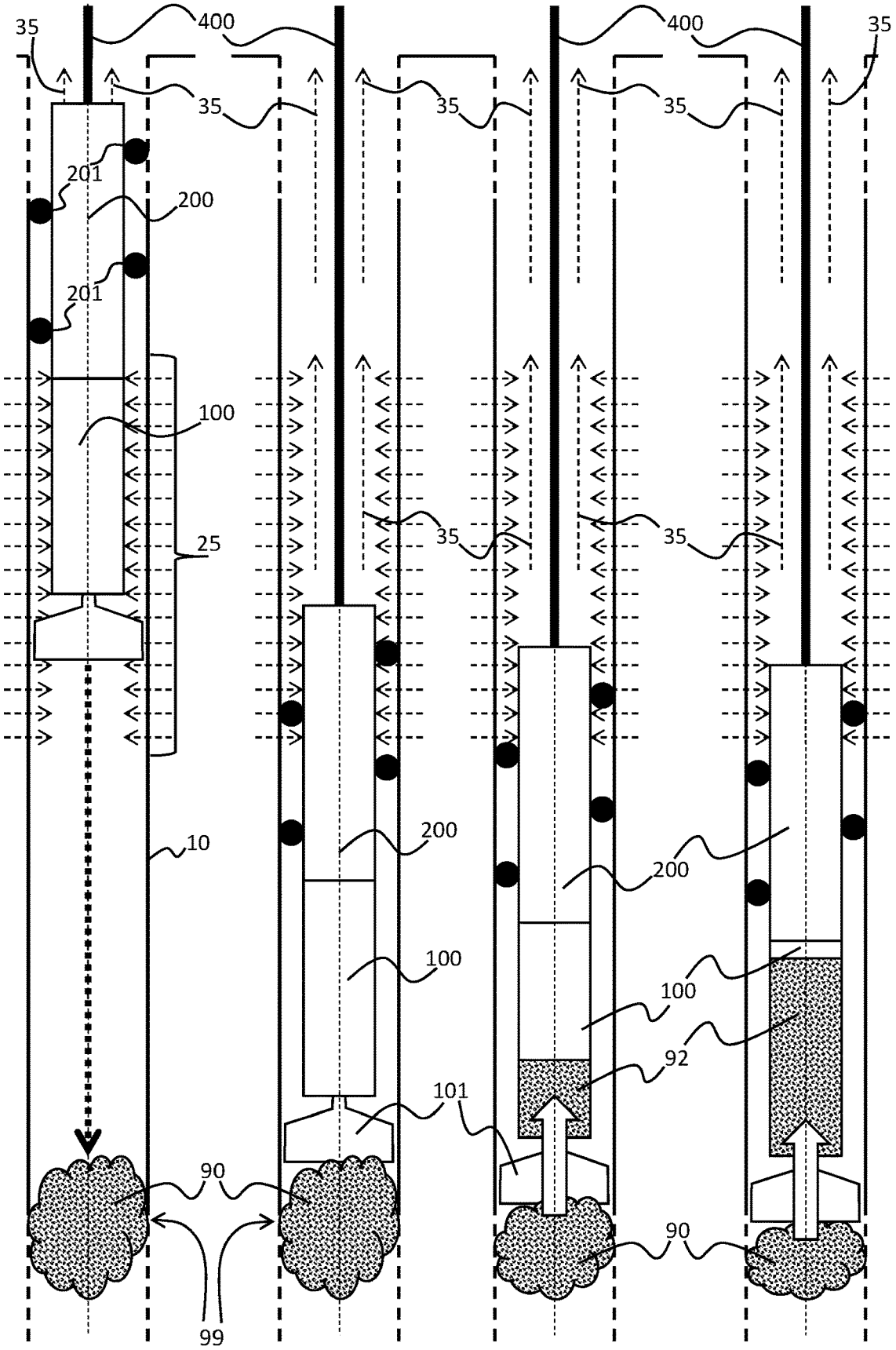

In the stage of FIG. 1*a* a collection tool 100 is provided that is configured for both selectively downhole collection of debris as well as selectively downhole releasing of said debris. The collection tools 100 of the prior art need to be adapted to offer this functionality. More information about the collection tool 100 that is to be used is given with reference to FIGS. 2 to 8. In the embodiment of FIGS. 1*a*-1*h* the collection tool 100 is coupled to a wireline tractor 200 that is coupled to a wireline cable 400. The collection tool 100 and the wireline tractor 200 (together forming part of a downhole tool assembly or tool string) are provided in a production tubing 10 of a petroleum well (not shown). Wireline tractors form part of well-known technology as such and therefore the wireline tractor 200 has been schematically illustrated in this specification, wherein only its wheels 201 have been illustrated in addition to the tool body of the wireline tractor 200.

The production tubing 10 has a (partial) choking due to clogged/settled/accumulated debris 90 at a specific location 99 as illustrated in FIG. 1*a*. Due to this choking there is hardly any or very little production from the production tubing underneath the debris 90. At a distance from the specific location 99, there is a production zone 25, which collectively results in a production flow 35 as illustrated by the vertical arrows within the production tubing 10. In FIG. 1*a* the downhole tool assembly 100, 200 is being lowered (as illustrated by the arrow) to the specific location 99.

In the stage of FIG. 1*b* the downhole tool assembly 100, 200 has landed at or in the debris 90. The collection tool 100 has a drill bit 101 that is capable of drilling/grinding the debris 90. In this figure the drilling/grinding process is to be started.

In the stage of FIG. 1*c* the debris 90 is being drilling, grinded and collected (for instance by means of a transport screw (not shown)) in the collection tool 100 (in a collection chamber thereof as will be discussed later in this specification). The amount of collected debris 92 in the collection tool 100 is increasing as the cleaning process continues, i.e. its collection chamber is being filled up.

In the stage of FIG. 1*d* the collection tool 100 has reached its maximum debris carrying capacity and the drilling/grinding/collection is stopped.

Figures 1E, 1F, 1G, 1H:
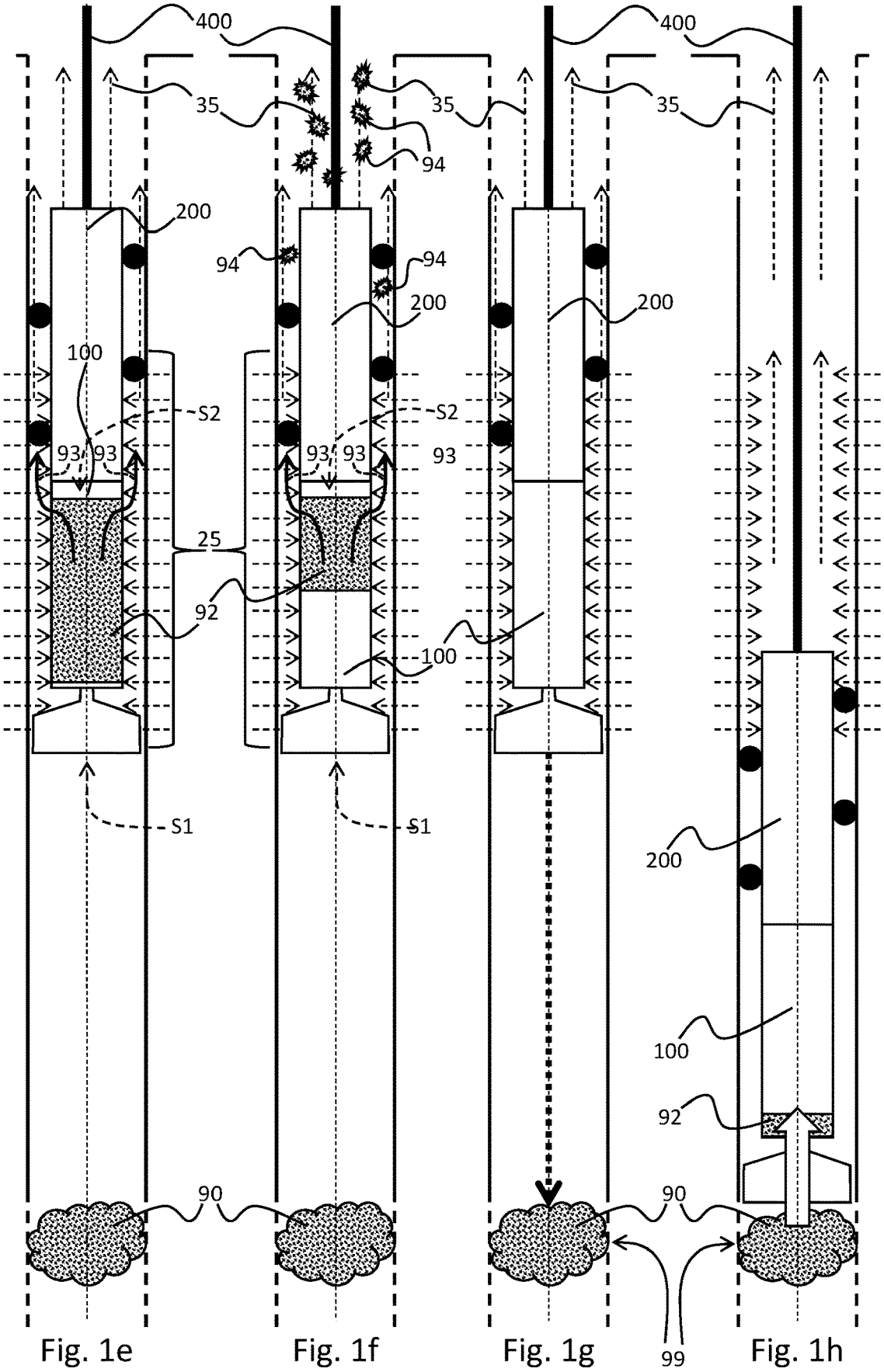

In the stage of FIG. 1*e* the collection tool 100 has been pulled up towards the production zone 25 and not to the surface as is the case in the prior art. Alternatively, it may be pulled up to a location downstream of said production zone 25 (not shown). In this stage emptying of the collection tool 100 is started, whereas in FIG. 1*f* this emptying process is ongoing, i.e. the collected debris 92 is released into the production flow as illustrated by the arrows. In order to releasing of collected debris 92 a release valve (not shown) may be implemented at a downstream side S2 of the collection tool 100. This valve may be opened and at the same time the upstream side S1 of the collection tool 100 may be opened. If there is a transport screw 55 or pump 51 in the collection tool 100 these are preferably activated. By doing so the production flow 35 may be guided and transported through the collection chamber of the collection tool 100 effectively washing the collection tool 100 clean from collected debris 92. The collected debris 92 leaves the collection tool 100 as an outflow 93 of collected debris 92 (illustrated by the arrows) to obtain released debris 94 that is being transported upwards by the production flow 35 as illustrated. At the surface there is a separator (not shown) that separates the debris from the production fluid. Such separator is considered to be well-known as such and is not elaborated on in this specification therefore.

In the stage of FIG. 1*g* (associated with FIG. 1*a*) the collection tool 100 has been emptied (has released all its collected debris 92) into the production flow 35. Subsequently the tool assembly 100, 200 is about to be lowered to the specific location 99 with accumulated debris 90, in case not all debris 90 has been removed.

In the stage of FIG. 1*h* (associated with FIG. 1*c*) the collection tool 100 is drilling, grinding and collecting debris 90 again, filling the collection chamber of the collection tool 100 with collected debris 92. The sequence of steps FIGS. 1*c* to 1*h* is repeated as long as the production tubing 10 is not substantially clean from debris 90.

As already mentioned FIGS. 1*a* to 1*h* are very schematic and strongly simplified. In reality, the situation can be much more complex. For instance, a well may have multiple production zones. In addition, a well may comprise deviated or horizontal zones. Moreover, the production zone 25 is quite often placed in horizontal or deviated zones of the well. Furthermore, the tool assembly 100, 200 is drawn with a length longer than the production zone 25. In reality the production zone 25 may be much longer than the tool assembly 100, 200. A well-known challenge in horizontal wells is precipitation and sand dune formation. The method of the invention conveniently removes such obstacles in the production tubing in the horizontal zones. Typically, the collection tool assembly will be withdrawn to vertically oriented production zones to release the collected debris in such cases in order to facilitate a proper lift of the released debris. In addition, it is possible that a single well has multiple branches, that each have deviated and horizontal zones. In such scenario the releasing of the collected debris may be typically done at a production zone that is located above all of these branches. This is in order to be able to benefit from a decent lifting capacity of the consolidated production flow.

It must be stressed that the amount of choices and solutions for implementing a collection tool 100 that can both collect and release debris downhole, is extremely large. By no means is the invention limited to any such collection tool 100. By way of example, some alternatives are discussed hereinafter.

Figure 2:
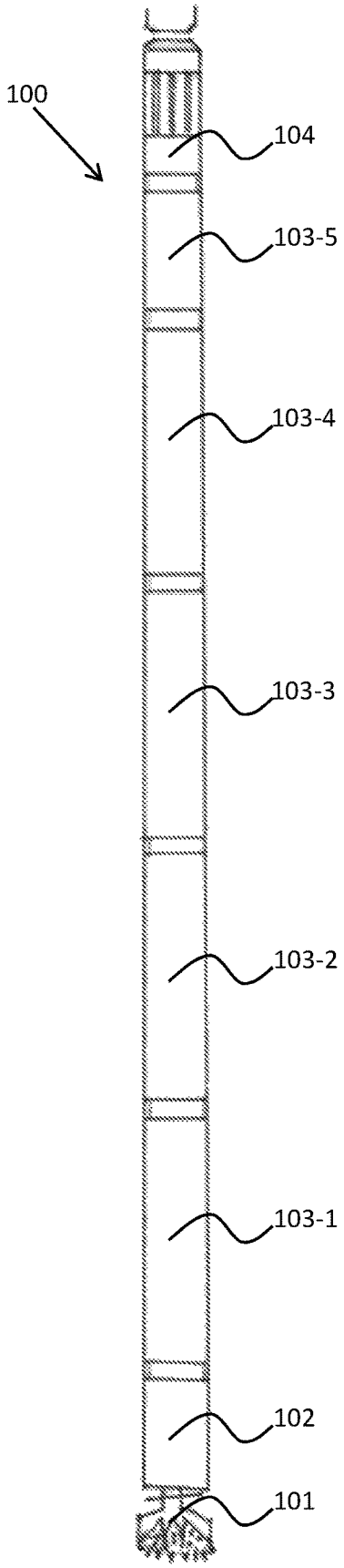
FIG. 2 shows an embodiment of a collection tool in accordance with the invention.

FIG. 2 shows an embodiment of a collection tool 100 in accordance with the invention. The collection tool 100 comprises a drill bit 101, for instance a rock bit as disclosed in patent application NO335492. The drill bit 101 is rotatably mounted to an input module 102 encompassing an input opening with a valve (not shown). The input module 102 is coupled to a series of collection chambers 103-1 . . . 103-5. Throughout the length of the series of collection chambers 103-1 . . . 103-5 there may be a transport screw (not shown). At the other end of the collection tool 100 there is a top collection chamber 104 with a filter. As known from the prior art. The function of this top collection chamber 104 is to allow fluid to leave the collection chambers 103-1 . . . 103-5, 104, while the filter keeps the debris inside while in debris collection mode. The top collection chamber 104 in this embodiment is also provided with a release valve (not shown). More information on the implementation of the release valve is given with reference to FIGS. 4-7.

Figure 3:
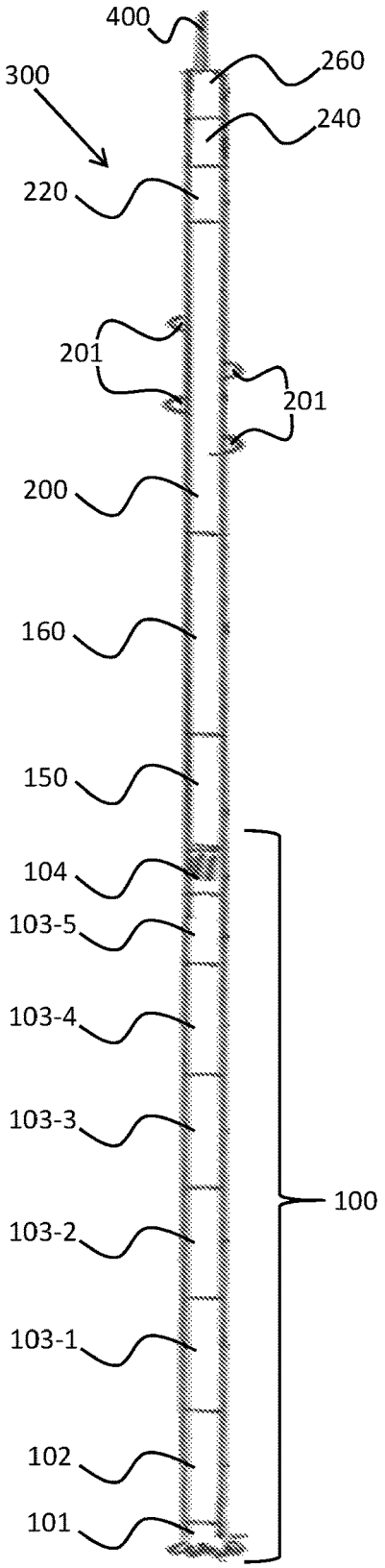
FIG. 3 shows a downhole assembly comprising the collection tool of FIG. 2 when connected to a wireline tractor.

FIG. 3 shows a downhole assembly 300 comprising the collection tool 100 of FIG. 2 when connected to a wireline tractor. The collection tool 100 is connected to a shock absorber 150 that is connected to a rotation motor 160 that is connected to the wireline tractor 200. On the other end of the wireline tractor 200 there is connected a casing collar collector 220, a swivel 240 and a cable head 260 that is connected to the wireline cable 400. A tool string 300 as illustrated in FIG. 3 is an example of what typically may be used in the oil industry. However, the invention is not limited to any specific tool string configuration.

Figure 4:
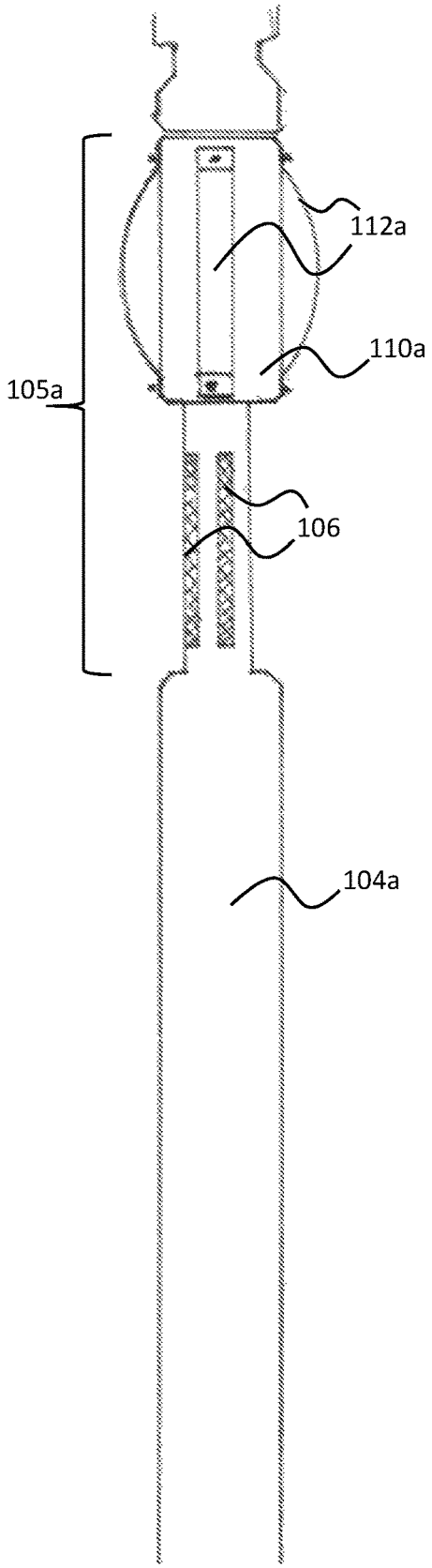
FIGS. 4-5 shows an embodiment of collection tool with a release valve in accordance with the invention.
Figure 5:
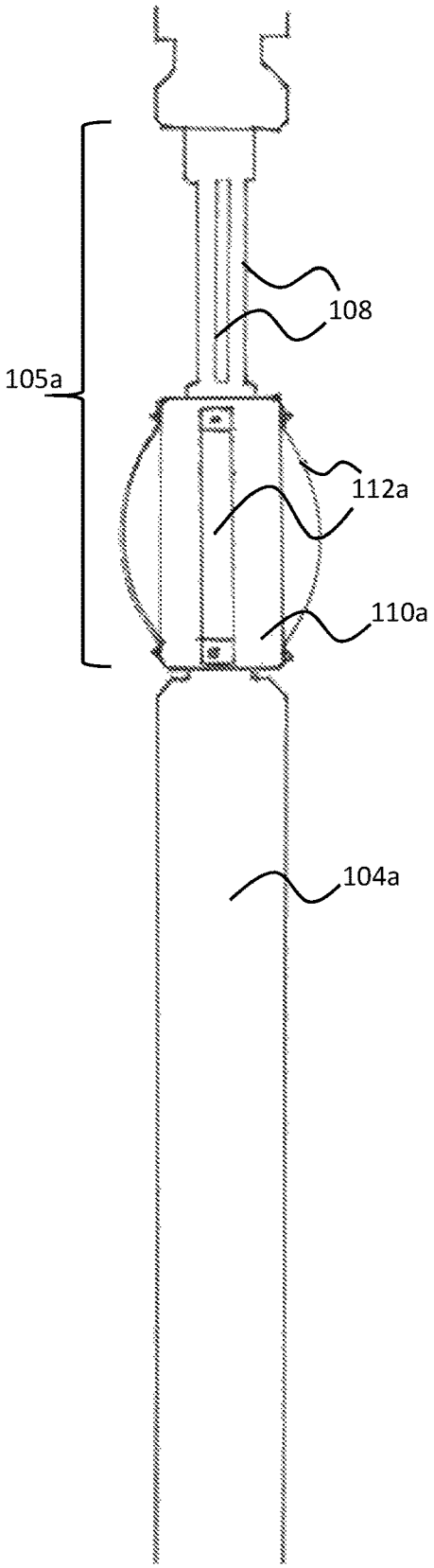

FIGS. 4-5 shows an embodiment of collection tool with a release valve in accordance with the invention. As already mentioned, the collection tool 100 (in FIGS. 2 and 3) in accordance with the invention must be configured such that it enables both collecting as well as releasing of debris. As far as the release of debris is concerned, it is to be noted that it is advantageous to release the debris at the downstream side of the collection tool 100. In this way the flow direction of the production flow helps in the releasing process. One way of facilitating selective release of debris is to implement a release valve 105*a* in the top collection chamber 104*a* as illustrated in FIGS. 4 and 5. The core of the implementation is a slideable friction member 110*a* as illustrated. As the figures illustrate the slideable friction member 110*a* has to different end positions, namely one where the friction member 110*a* exposes the filter 106 (FIG. 4) and one where it covers the filter 106 and exposes an opening 108 (FIG. 5). Expressed differently, the release valve 105*a* in FIG. 5 bypasses the filter 106 with the opening 108, which enables the collected debris in the collection chamber to be released into the production tubing (not shown).

Figure 6:
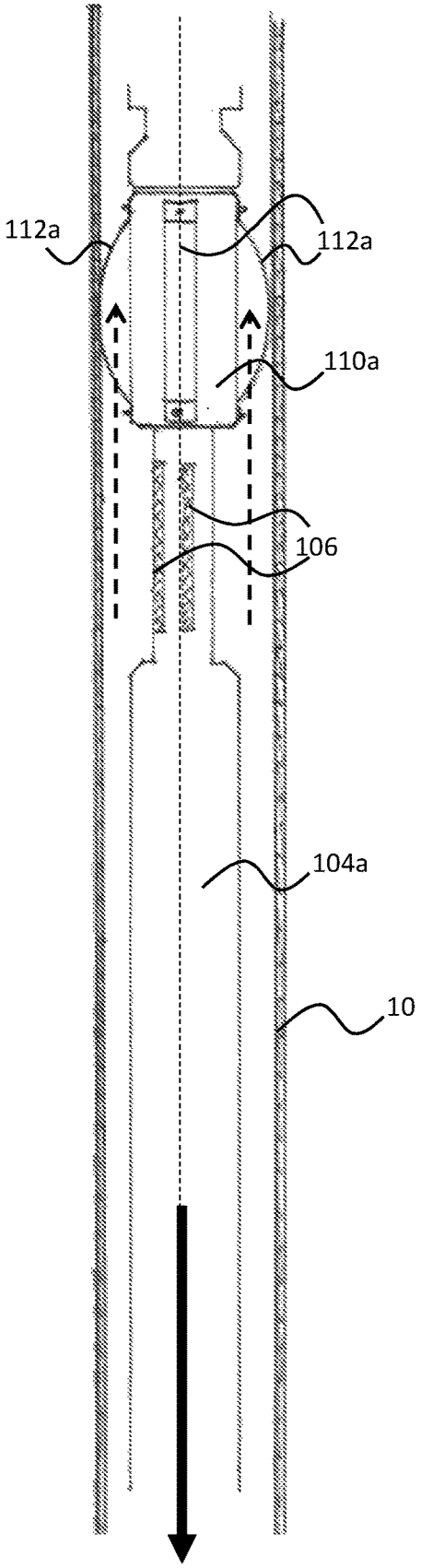
FIG. 6 shows the operation principle of the release valve shown in FIGS. 4-5.

FIG. 6 shows the operation principle of the release valve shown in FIGS. 4-5. The friction member 110*a* in the figures is implemented with friction elements in the form of metal spring elements 112*a*. These metal spring elements 112*a* engage with and press against the sidewalls of the production tubing 10 to obtain a friction there between. When the collection tool is moved downwards (towards the partial choking zone 99) in accordance with the thick arrow this friction will cause the slideable friction element 110*a* to move to the position as illustrated in FIG. 6, indicated by the dashed arrows. In this way the filter 106 is exposed and the opening (not shown) is covered. Likewise, then the collection tool would be moved in the opposite (upward direction, towards the production zone/surface) the slideable friction element 110*a* will move to the position covering the filter 106 and exposing the opening 108 (see FIG. 5). When the transport screw is then started the collection chamber will empty itself (possible assisted by the production flow flowing through the collection chamber).

Figure 7:
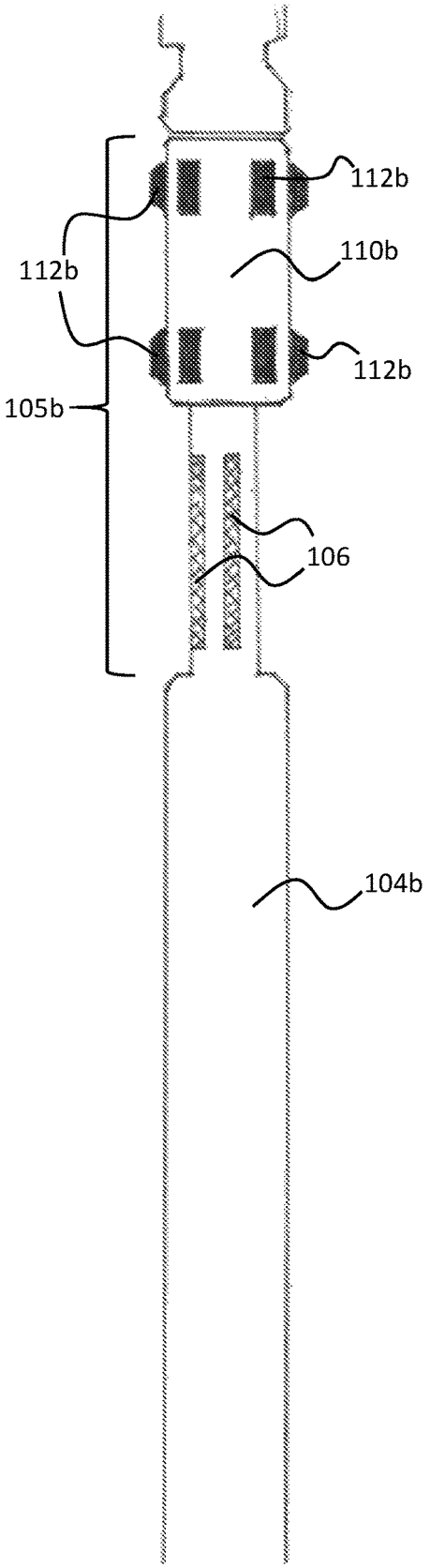
FIG. 7 shows another embodiment of a collection tool with a release valve in accordance with the invention.

FIG. 7 shows another embodiment of a collection tool with a release valve 105*b* in the top collection chamber 104*b* in accordance with the invention. This embodiment will only be discussed in as far as it differs from the embodiment of FIGS. 4-6. The respective slideable friction member 110*b* in this embodiment comprises a plurality of solid friction elements 112*b*.

Figure 8:
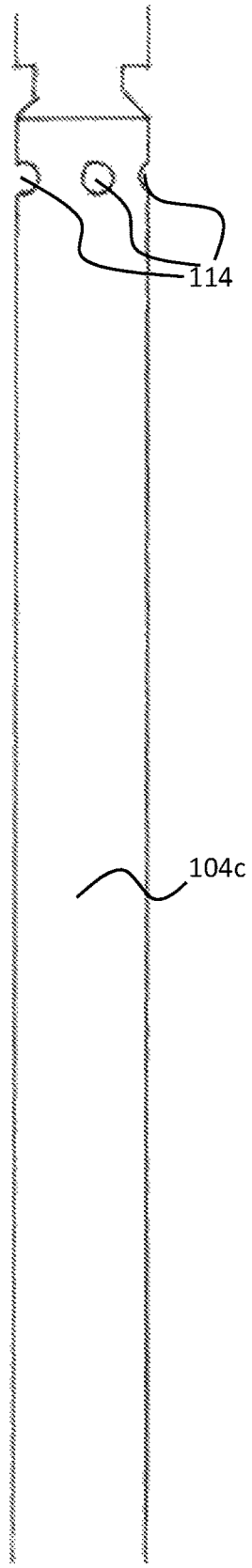
FIG. 8 shows yet another embodiment of a collection tool with a release port in accordance with the invention.
Figure 9:
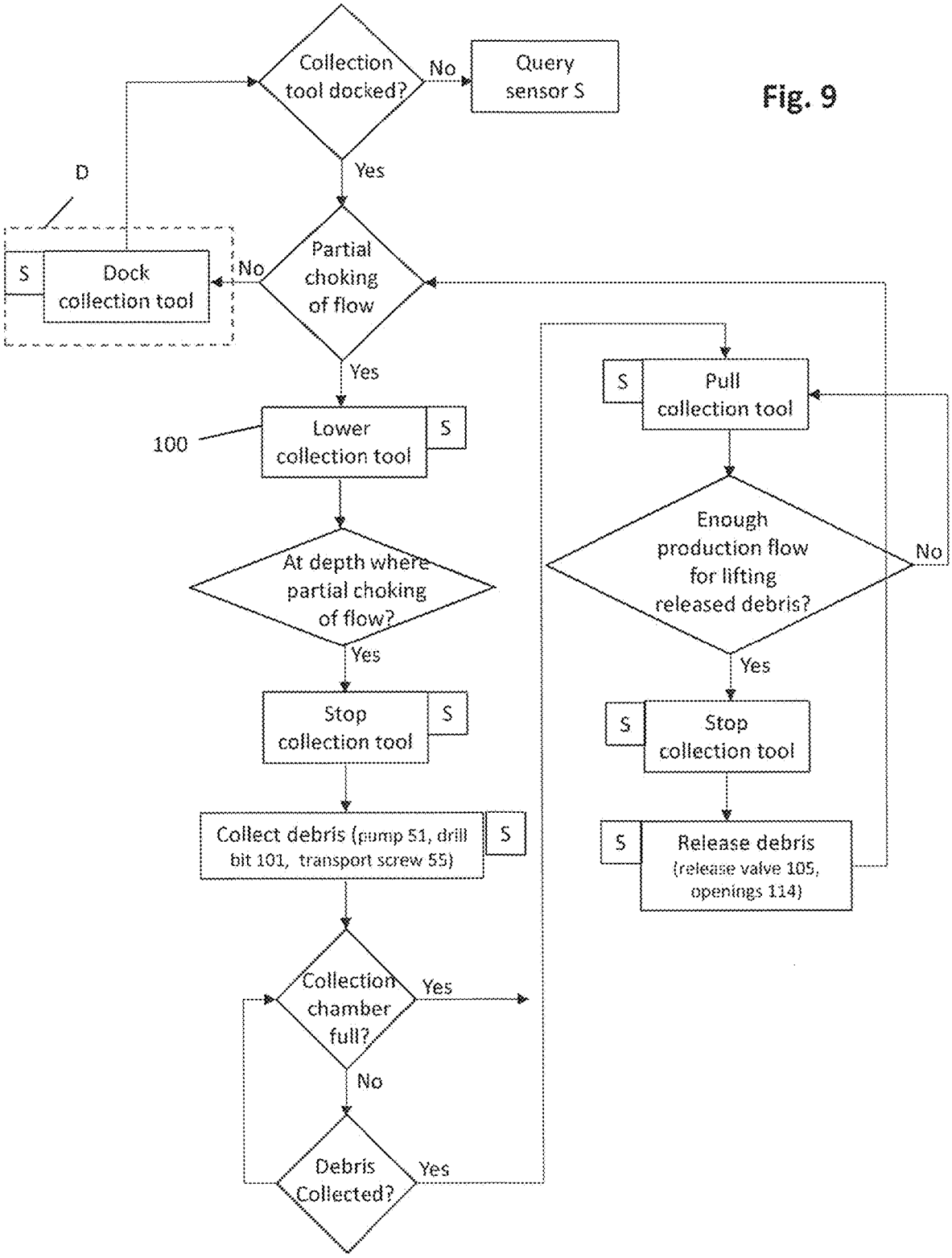
FIG. 9 shows a schematic of an embodiment of a method for use with a collection tool of this disclosure.

FIG. 8 shows yet another embodiment of a collection tool with a release port in accordance with the invention. This embodiment will only be discussed in as far as it differs from the embodiment of FIGS. 4-7. Instead of a release valve there is implemented a release port formed as a plurality of openings 114 at the downstream side of the top collection chamber 104*c*. There is no filter and no slideable friction element. Structurally this embodiment is very simple, yet it requires a more clever approach while collecting debris in that more control is required on the amount of debris collected. Expressed differently the collection of debris must be stopped when the debris almost approaches said openings. One way of achieving this is to implement a filling level indicator. This may be done in the form of a sensor "S" actually measuring the volume or in the form of a flow meter measure the amount of debris passing the opening at the upstream side of the collection tool. When the collection tool of FIG. 8 is brought to the production zone for emptying the collection chamber, all what is required is that the transport screw is started.

Wherever in this description the word "transport screw" is mentioned this may—be replaced with a pump, both having the function of collecting and transporting the debris into the collection chamber and pushing it out of the collection chamber when necessary.

As may be understood from the above the invention is about exploiting the lifting capacity of a production flow to transport debris to the surface, such that the debris collection tool does not need to be pulled to the surface, which really safes a tremendous amount of time and thereby costs. Of course, the prerequisite is that the petroleum well has at least a minimum flow rate of the production flow in order to lift the debris to the surface. As discussed earlier the benefits of the invention are large and numerous.

The amount of variations in the equipment used for the method of the invention is huge. A number of variations and options is discussed below. In addition, some considerations are discussed.

In embodiments of the invention the debris collector (=collection tool) comprises a worm screw that transport debris form the leading end and into the collection chamber. The debris collector may further comprise a worm screw that runs through at least a portion of the collection chamber.

In alternative embodiments, debris is sucked into the collection chamber. A pump such as a PC pump, centrifugal pump, a venturi pump system or another type of pump creates a sub-pressure within the collection chamber.

Emptying of collected debris in the collection chamber may in the first embodiment be done by activating the worm screw, and in the second embodiment by activating the pump. An alternative is to use the production flow to wash through the collection chamber and bring the debris into the production flow.

In a vertical well or in a well close to being vertical, the collection tool may be displaced without a tractor. Anchoring of the tool may be done by a friction equipment towards the well wall, by a stroker equipment, or interaction with profiles within the well. In some cases no anchoring at all is needed as the tool string may be heavy enough by itself, or the tool string comprises additional weight bodies.

Collection of debris and separation of the debris from a well is known in the prior art. Known wireline operated collecting equipment is constructed for filling carried, closable chambers with debris, lift the collecting chambers within the vertical well path and out from the well without leakage of debris. In addition, the equipment is constructed for easy disassembling and cleaning outside the well.

The collection tool may comprise a release valve (check valve), a pump adapted to pump in the reverse direction, full opening, and a sensor or indicator "S" for filling degree of the collection chamber.

In another embodiment the well may comprise a docking device "D" in a portion where emptying of the collection tool is desirable. When the collection tool is positioned in the docking device and then further displaced towards the surface, a release valve is switched from a closed position to an open position. Emptying of the collection chamber is then carried out. After emptying, the collection tool is displaced towards the debris area and the release valve is switched from the open position to the closed position.

In another embodiment a provisional, and releasable anchor device is positioned in the well at a position of choice. The provisional anchor device comprise a docketing device. The provisional anchor device safe guards that the flow of production fluid does not detach in an uncontrollable manner from the collection tool, which may result in an expensive and time-consuming fishing operation.

In an alternative embodiment, when provisional anchor device or other suitable internal profiles are not available in the production tubing, anchoring may comprise known friction systems in addition to anchors of a tractor or a stroker device.

The release valve may be one of several types depending on characteristics of the well, production rate, type of collection tool and most important type of debris.

The method according to the invention is highly appropriate for removal of debris comprising fine materials as sand and silt. In addition, the method is suitable for removal of production deposits such as scale. With scale, the collection tool comprises a rotating bit for loosening of the scale prior to feeding the loosened scale into the collection chamber. Another type of debris is settled mud particles.

In another embodiment, a provisional, releasable profile or docking device is installed at a position of choice where the flow of production fluid is sufficient to carry material to the surface. The profile or docking device is a releaser adapted to open and close the release valve. The releaser may collaborate with spring-tensioned dogs on the release valve. As an alternative, the spring tensioned dogs may be positioned on the profile or docking device.

In other embodiments, the collection tool comprises a pump. The pump will assist in wash out of the collection chamber. Pumping direction may be the same at emptying as at filling. In an alternative embodiment the pumping direction is reversed and collected material is squeezed out to the surroundings through a check valve at the end portion opposite of the collection tool's pump end portion. A PC pump is in particular suitable for such an operation.

Dependent on type of cleaning equipment, the cleaning tool comprises a dumping device suitable for the purpose.

It may be advantageous if the collection tool is properly anchored and not due to slipping within the production well when the production fluid is flowing. This is achievable without provisional installed equipment. A bottom hole tool operated by wireline may comprise additional friction elements. In addition the anchors of a tractor may be activated and the dumping position is kept stable. The safety margin is satisfactorily.

Several types of gauges and sensors "S" may be beneficial for efficient operation of the collection tool.

The bottom hole assembly may comprise a tension sub and a compression sub at both sides of the anchor. The pressure from the well fluid flow acting on the tool may be monitored and the quality of the anchoring may be kept under surveillance. The same sensors may provide information about thrust when collection of debris is ongoing. In addition valuable information is provided by these sensors when the collection tool is displaced from the area of collection to the area of emptying.

Pressure sensors may indicate a drop-in pressure when the well is activated. Internal and external temperature sensors may indicate normal working conditions for the equipment and the operation.

Vibration indicator in the tool string may indicate operational running and anchoring and give a warning when operation becomes irregular.

A gyro sensor may indicate anchoring and movements of the collection tool at collection and at emptying.

A flow meter may be positioned on the tool to check for sufficient fluid flow when wash out is initiated. A flow-meter may also be used to identify or locate sufficient lifting capacity in the area of collection. If the clean-up of debris releases flow of production fluid from a previous blocked production area, and the fluid flow is sufficient for lifting up the collected material, the whole operation may become more efficient. The emptying area may then be located close to the collection area and the distance of displacement between the collection area and the emptying area is greatly reduced. Such a development may occur if sand and silt have formed short plugs and thereby cut off deeper production zones. When such plugs of sand and silt are removed, displacement of the collection tool to the emptying area is terminated with a gain in efficiency.

The tool string may comprise a Casing Collar Locator (CCL). The CCL gives improved control of the actual depth location of the tool string, and may also indicate uncontrolled displacement of the tool string.

When a wireline operated tractor is displacing the collection tool, and anchoring the tool string, the sensors of the tractor is used for monitoring the operation. The tractor may comprise thrust sensors, reading of engine power, vibration, temperature et cetera.

In some cases it may be that filling of the collection chamber has caused an undesirable compaction of the debris particles. Such a compaction may hamper the emptying process. A vibration unit may create sufficient shaking to loosen the material and make the emptying of the collection chamber more efficient. The vibration unit may be a dedicated sub. The efficiency of the vibration sub may be monitored by the tractor's accelerometer.

The efficiency of the clean out operation in the well may be monitored by a measurement equipment at the surface, e.g. a test separator. Operation depth is measured by CCL and the CCL reports on progress.

The described method of cleaning a well by providing active assistance to obtain a self-cleaning mode, simplifies the procedures and increase efficiency given that circumstances are appropriate for the method. This has not been achieved previously by wireline operated cleaning devices.

Efficiency of wireline operated collection devices in horizontal production tubing, is limited by several restrictions in the well system, and due to that the collection device needs to be pulled to the surface for emptying. Use of the production fluid's carrying capacity for wash out gives in addition to detachment of debris, collection, displacement and emptying within the well, gives more efficient wireline operations.

Comparable effect to the present invention is obtainable with coiled tubing operation, only. As discussed above, a coiled tubing operation is costly due to the extent of necessary equipment. Especially on offshore installations, where coiled tubing equipment need to be transported by a vessel, the present wireline operated wash out procedure is beneficial in terms of cost, time and efficiency.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. Method of cleaning a production tubing (10) in a producing petroleum well while selectively collecting and releasing debris downhole, the method comprises steps of:

lowering a collection tool to a specific location at a certain depth into the production tubing of the producing petroleum well where there is at least a partial choking of a local production flow due to accumulated debris deposited on the production tubing;

collecting said accumulated debris with the collection tool to obtain collected debris;

pulling said collection tool to a production of the production tubing or downstream of said production zone having enough production flow during production of the producing petroleum well to ensure a lifting capacity for the collected debris; and releasing said collected debris into the production tubing to obtain released debris being lifted by the production flow when production of the producing petroleum well is running.

2. The method in accordance with claim 1, wherein the production of the producing petroleum well is started before releasing said collected debris.

3. The method in accordance with claim 1, wherein the production of the producing petroleum well is started after releasing said collected debris.

4. The method in accordance with claim 3, wherein releasing said collected debris is carried out during controlled movement of said collection tool.

5. The method in accordance with claim 3, wherein the collection tool is placed below the production zone before the production of the producing petroleum well is started.

6. The method in accordance with claim 1, wherein the method further comprises anchoring said collection tool during releasing said collected debris into the production tubing.

7. The method in accordance with claim 1, wherein the method further comprises a step of anchoring said collection tool during the step of collecting said accumulated debris.

8. The method in accordance with claim 1, wherein the released debris (94) is separated from the production flow at a surface of the petroleum well.

9. The method in accordance with claim 1, wherein the steps of lowering said collection tool, collecting said accumulated debris, pulling said collection tool, and releasing said collected debris, are repeated until all accumulated debris is removed at the location of the partial choking to restore the production of the producing petroleum well at or underneath the specific location.

10. A collection tool assembly adapted to collect solid debris in a production tubing in a first state at a first production depth located toward an upstream end in a producing petroleum well having a first production flow and, in a second state different than the first state release collected solid debris at a second production depth located toward a downstream end in the producing petroleum well at having a second production flow, said collection tool assembly comprises:

a wireline tractor; and a collection tool including a downstream end and an upstream end, the downstream end including means for connection to the wireline tractor; the upstream end including a rotatable drill;

at least one collection chamber located toward the upstream end and adapted to selectively collect the solid debris and at least a portion of the first production flow;

at least one release valve located toward the downstream end and adapted to, in the first state of the collection tool downhole, selectively release the portion of the first production flow while retaining the collected solid debris in the at least one collection chamber and, when in the second state of the collection tool downhole, selectively release the collected solid debris and a portion of the second production flow;

the wireline tractor connected to the collection tool, the collection tool moveable by way of the wireline tractor.

11. The collection tool assembly in accordance with claim 10, the release valve further comprising a slideable friction member for engaging with the production tubing, wherein a relative position of the slideable friction member relative to the collection tool controls the release valve.

12. The collection tool assembly in accordance with claim 10, wherein the collected debris is released at a downstream side (s2) of the collection tool.

13. The collection tool assembly in accordance with claim 12, wherein the collection tool leads the production flow of the producing petroleum well at least partially from an upstream side (s1) through the at least one collection chamber of the collection tool to the downstream side (s2) for washing out the collected debris.

14. The collection tool assembly in accordance with claim 10, further comprising at least one of a pump and a transport screw in communication with the at least one collection chamber.

15. The collection tool assembly in accordance with claim 10, wherein the collection tool includes a filling level sensor (S) indicator to indicate a filling level of the collection chamber.

16. The collection tool assembly in accordance with claim 10 comprising a docking station.

17. A collection tool assembly adapted to collect solid debris in a production tubing in a first state at a first production depth located toward an upstream end in a producing petroleum well having a first production flow and, in a second state different than the first state release collected solid debris at a second production depth located toward a downstream end in the producing petroleum well having a second production flow, said collection tool assembly comprises:

a wireline tractor; and a collection tool including a downstream end and an upstream end, the downstream end including means for connection to the wireline tractor; the upstream end including a rotatable drill controllable between a drilling mode and non-drilling mode;

at least one collection chamber located toward the upstream end and adapted to selectively collect the solid debris and at least a portion of the first production flow;

at least one release port located toward the downstream end;

a filling level sensor indicator arranged to indicate a filling level of the at least collection chamber, a predetermined maximum fill level being less than a total fill level of the at least one collection chamber between an upstream side of the at least one collection chamber and the at least one release port, a first fill level being less than the predetermined maximum fill level;

at least one of a transport screw and pump;

wherein when in the drilling mode in the first state of the collection tool downhole and the filling level of the at least one collection chamber is less than the predetermined maximum fill level, the collection tool assembly selectively releases the portion of the first production flow through the at least one release port while retaining the collected solid debris in the at least one collection chamber and;

wherein when the fill level equals the predetermined fill level, the collection tool assembly transitions to the non-drilling mode and the second state of the collection tool downhole; and wherein when in the non-drilling mode in the second state of the collection tool downhole, the collection tool assembly selectively releases the collected solid debris and a portion of the second production flow;

the wireline tractor connected to the collection tool, the collection tool moveable by way of the wireline tractor.

* * * * *